US005269076A

United States Patent [19]

Breckenridge

[11] Patent Number: 5,269,076

[45] Date of Patent: Dec. 14, 1993

[54] BALANCED DRAFT VENT SYSTEM FOR KILN

[75] Inventor: Leon Breckenridge, Spokane, Wash.

[73] Assignee: U.S. Natural Resources, Inc., Vancouver, Wash.

[21] Appl. No.: 827,148

[22] Filed: Jan. 27, 1992

[51] Int. Cl.[5] ..... F26B 5/04

[52] U.S. Cl. ..... 34/15; 34/54; 34/1.91

[58] Field of Search ..... 34/15, 35, 86, 50, 46, 34/54, 191

[56] References Cited

U.S. PATENT DOCUMENTS

| | | | |
|---|---|---|---|
| Re. 28, 226 | 11/1974 | Cook | 34/191 |
| 3,659,352 | 5/1972 | Cook | 34/191 |
| 4,570,357 | 2/1986 | Kuboyama | 34/15 |

*Primary Examiner*—Henry A. Bennet
*Attorney, Agent, or Firm*—Robert L. Harrington

[57] ABSTRACT

A balanced draft vent system for a lumber kiln is shown and described wherein external and internal air pressure differential is taken into account in conjunction with internal humidity measurement in providing a balanced volumetric exchange of cool moisture laden air exiting the kiln and ambient air introduced into the kiln. The air exchange function of the balanced draft vent system operates independent of the driving forces of air circulation within the kiln.

13 Claims, 5 Drawing Sheets

BALANCED DRAFT VENT SYSTEM FOR KILN

BACKGROUND OF THE INVENTION

Large enclosures are used as kilns for removing moisture from lumber products by circulation of heated air. For example, green lumber is stacked for drying by placing stickers between each layer of lumber to permit air flow therethrough and the stacks are placed in heated building structures, i.e., kilns, with controlled ventilation and circulation to pass sufficient air through the stacks and carry away the moisture of the lumber.

Most lumber dying kilns rely on internal circulating fans to exhaust the air and replace it with fresh air. For example, by placement of vents on each side of the circulating fans and controllably opening and closing these vents, it is possible to exhaust air from a vent on one side of the circulating fan and draw air into the kiln from a vent on the other side of the circulating fan. When the circulating fans reverse direction, the exhaust vent becomes the intake vent and the intake vent becomes the exhaust vent. Kilns have, therefore, taken into account circulating fan direction and used the circulating fan as a motive force for removing moisture laden air from the kiln and for introducing fresh or make-up air into the kiln. Once the lumber is suitably dried, the stacks are removed from the kiln and further processed or restacked as necessary.

Air is the transport media for picking up moisture at the surface of the lumber product to be dried and moving that moisture to another location for disposal, i.e., exterior of the kiln. It may be appreciated, therefore, that, in order to suitably remove the moisture content of such lumber, it is necessary to monitor the humidity and temperature of air within the kiln. Thus, the manner in which the kiln responds to detected heat and humidity within the kiln plays an important role in the process of kiln drying of lumber.

Such prior kiln systems using internal circulating fans as the motive force for removing moisture laden air are energy inefficient. More particularly, the moisture laden air taken from the kiln is taken just after such air has been heated by the heating element of the kiln. Accordingly, the energy applied to the heating of this air is immediately lost as part of the venting function of the kiln. Also, in such prior systems, tests have shown that as little one-eighth inch change in the vent opening can result in a change of as much as five degrees Fahrenheit in wet bulb humidity measurement. Thus, such prior vent systems cannot provide precise control over internal kiln humidity.

Conventional kiln sensor arrangements and conditions detected thereby include temperature detection by dry bulb and wet bulb sensors whereby a measure of humidity may be calculated. Other kiln condition detection methods include "cellulose" wafers designed to represent the equilibrium moisture content of wood. All kilns, except dehumidification type kilns, vent the moisture laden air to hold a wet bulb condition, i.e., humidity of air within the kiln, down to some desired level. There are computer controlled lumber drying kilns with software configurations providing a variety of control functions.

It is desirable that a kiln system be energy efficient and precise with respect to its control of humidity within the kiln for optimum removal of cooler moisture laden air.

SUMMARY OF THE INVENTION

The balance draft vent system of the present invention initiates venting automatically when required to remove high humidity, lower temperature air from the kiln at a controlled flow rate while adding make-up ambient air at a controlled flow rate. This balance draft system uses an equal and opposite volume of air exchange accounting for the variability of density, relative humidity, temperature, etc. of both exiting air and incoming air. This balance draft approach automatically compensates for these variables with one simple and easily measured parameter, i.e., differential air pressure between kiln internal and kiln external conditions. One advantage of such a system according to the present invention is minimization of incoming air. Thus, an object of the present invention is to provide improvement in use of the media, i.e., air, for removing moisture content from wood products.

Venting in accordance with the present invention controls the internal air pressure of the kiln with respect to the outside atmospheric condition regardless of wind speed or direction, barometric pressure, temperature or relative humidity.

In accordance with a preferred embodiment of the present invention, a power driven vent allows uniform collection of moisture laden air within the kiln and exhaust of the moisture laden air prior to being reheated or being mixed with any other air, especially incoming fresh air. A separate substantially identical power driven vent uniformly collects make-up air for introduction into the kiln. The exhaust and intake functions of these power driven vents may be reversed according to the direction of air circulation within the kiln in order to optimize the replacement of moisture laden air with incoming make-up air. The control strategy according to the present invention assures that simultaneously with release of a volumetric unit of exhaust air a corresponding unit of fresh air is forced into the kiln in order to balance these two volumes. In the preferred embodiment, relative pressure between the internal kiln pressure and outside atmospheric condition is maintained negative within the kiln, e.g., 0.05" WC, below outside atmospheric conditions. The system will work, however, over a wide range of differential internal pressure, typically from −0.25" WC to a +0.26" WC of internal pressure relative to external pressure.

The subject matter of the present invention is particularly pointed out and distinctly claimed in the concluding portion of this specification. However, both the organization and method of operation of the invention, together with further advantages and objects thereof, may best be understood by reference to the following description of a particular embodiment of the invention taken with the accompanying drawings wherein like reference characters refer to like elements.

BRIEF DESCRIPTION OF THE DRAWINGS

For a better understanding of the invention, and to show the same may be carried into effect reference will now be made, by illustrating a particular embodiment of the invention, to the accompanying drawings in which.

DETAILED DESCRIPTION

Figure 1:
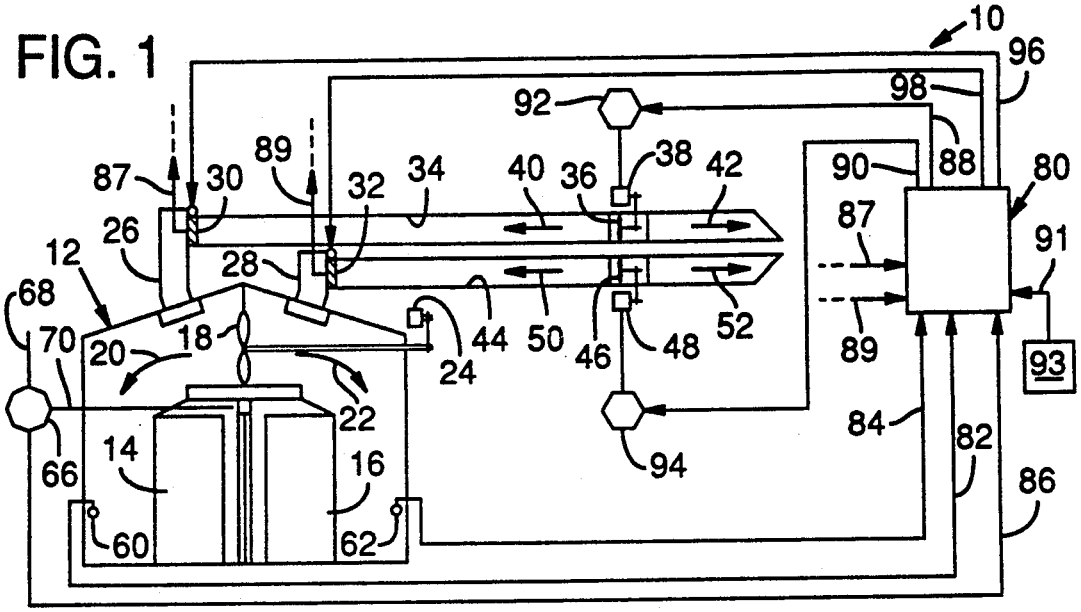
FIG. 1 is a schematic illustration of a balance draft venting system in accordance with the present invention.

FIG. 1 is a schematic illustration of a balance draft system 10 in accordance with a preferred embodiment of the present invention as applied to a lumber kiln 12. In FIG. 1, the kiln 12 is shown in end view from the green end with a left load 14 and right load 16 as a kiln charge therein. Kiln circulating fans 18 are positioned in an upper portion of the kiln 12 above loads 14 and 16 and provide air circulation in a forward direction 20 and reverse direction 22. Bi-directional fan motors 24 drive the fans 18 suitably in the directions 20 and 22. Heating elements (not shown) are distributed within the kiln 12 for heating kiln 12 air circulating under the influence of fan 18.

In the illustrated embodiment, balanced draft venting is accomplished by a pair of power vents each comprising a damper and a bi-directional fan for selectively moving at controlled rates air into or out of the kiln 12. In the following discussion, two such power vents will be described and illustrated with reference to associated sensor devices and control modes of operation. It will be understood, however, that in a particular implementation of the present invention a number of such power vent pairs and associated sensor devices may be used in single kiln to accomplish balanced draft venting in accordance with the present invention.

A left ceiling vent 26 and right ceiling vent 28 provide air media access to and from the interior of kiln 12. Left shut off damper 30 and right shut off damper 32 open and close access to the interior of kiln 12 by way of vents 26 and 28, respectively. More particularly, the left shut off damper 30 lies intermediate of ceiling vent 26 and a left vent duct 34 whereby a left vent fan 36 and associated drive motor 38 in cooperation with shut off damper 30 provide air inflow 40 and air outflow 42 within the duct 34. The shut off damper 32 lies intermediate of the right ceiling vent 28 and a right vent 44 whereby a right vent fan 46 and associated drive motor 48 in cooperation with the shut off damper 32 provide air inflow 50 and air outflow 52 within the duct 44. In practice, it is suggested that the fans and associated motors be located within the ducts.

Thus, the vent 26, shut-off damper 30, and vent fan 36 constitute a bi-directional power vent assembly. Similarly, the vent 28, shut-off damper 32, and vent fan 46 constitute a second bi-directional power vent assembly. Each power vent assembly may be operated as an intake vent to push air into kiln 12 or as an exhaust vent for pulling air out of kiln 12.

Humidity within kiln 12 is monitored by way of a left wet bulb 60 and a right wet bulb 62. Other sensing devices providing a measure of relative humidity, however, may be used. Relative air pressure between outside atmospheric conditions and those within kiln 12 is monitored by a differential pressure transmitter 66. More particularly, differential pressure transmitter 66 includes a first fresh air inlet 68 communicating with outside ambient air and a second kiln air inlet 70 communicating with air within kiln 12, specifically near the top and intermediate of loads 14 and 16. The location of the inlet 70 can be at a variety of locations within kiln 12, but as illustrated is located near the top of loads 14 and 16 and should be neutral or balanced relative to the internal circulation provided by fans 18. This insures that little or no internal pressure reading error occurs as a result of air circulation provided by circulating fans 18.

As may be appreciated by those skilled in the art, atmospheric pressure can vary greatly and effect significantly the operation of a lumber drying kiln. For example, when the barometric pressure drops or rises, the relative pressure between internal and external pressure conditions varies. Such changes in barometric pressure can, in extreme cases, result in damage to the kiln 12, but more typically result in either undesirable leakage of air from within the kiln 12 or undesirable introduction of external air into the kiln 12. One important aspect of the present invention is the use of a differential pressure measurement and a control response for maintaining a substantially constant differential pressure between internal and external air pressure conditions. In this manner, i.e., by monitoring differential pressure, the external air pressure, i.e., the absolute barometric pressure, has reduced significance in the overall operation of a lumber drying kiln according to the present invention.

A control 80 of the balance draft system 10 is coupled to the above-noted elements of system 10 for monitoring the condition of kiln 12 and actuating the components of system 10 according to the present invention. The control 80 may be provided by conventional, commercially available analog type industrial process controllers. Thus, control 80 receives inputs 82 and 84 from wet bulbs 60 and 62 for monitoring the humidity within kiln 12. Input 86 arrives from the differential pressure transmitter 66 whereby control 80 monitors the pressure differential between outside ambient atmospheric pressure and internal kiln 12 pressure. Control 80 provides outputs 88 and 90 for application to fan motor inverter drives 92 and 94 for suitably controlling the direction and speed of fans 36 and 46, respectively. Outputs 96 and 98 couple to the shut off dampers 30 and 32, respectively, for controllably actuating the dampers 30 and 32. The outputs 96 and 98 are power voltage outputs applied directly to the shut off dampers 30 and 32 which are normally closed, but upon application of power from respective outputs 96 and 98 the dampers 30 and 32 open. The input 86 is an analog signal representing a differential pressure according to its value within a given range.

The control 80 receives an input 91 from a kiln control 93. Input 91 represents the circulating fans 18 mode of operation and serves as a master control over the illustrated balanced draft venting system. The control 93 is a general purpose control for the kiln 12, apart from that provided by control 80, and includes a timed control function over the operation of motors 24 and the circulation of air within kiln 12 by way of circulating fans 18. As in conventional kiln systems, the control 93 periodically reverses the direction of fans 18 to provide the above-noted forward circulation 20 and reverse circulation 22. Thus, control 80 is responsive, by way of its input 91, to the operating mode for the circulating fans 18, i.e., is responsive to the direction of air circulation within kiln 12.

The control 80 also receives inputs 87 and 89 from the shut off dampers 30 and 32 as a representation of the condition of dampers 30 and 32, respectively. For example, each of dampers 30 and 32 may be provided with a limit switch (not shown) to indicate to the control 80 an open or closed condition of dampers 30 and 32.

In operation, the circulating fan 18 serves as a master control as it reverses directions on a periodic basis. As explained more fully below, the condition of shut-off dampers 30 and 32 and the speed and direction of fans 36 and 46 is a function of the circulating fan 18 direction in conjunction with detected differential pressure conditions and humidity conditions of the kiln 12. A feature of the balanced draft system according to the present invention is that reversal of internal circulating fans 18 does not affect the controllability of the venting action. Thus, the control 80 utilizes its input 91 as provided by the control 93 of kiln 12 to drive its mode of operation. With the input 91 indicating a forward circulating direction 20 within kiln 12, control 80 selects certain resources, i.e., sensors and vents, for venting in accordance with the present invention. If the input 91 indicates air circulation in the reverse direction 22, however, control 80 reconfigures its resource assignments. More particularly, in the preferred embodiment of the present invention in one circulating direction one of the power vents is used as an exhaust vent and is responsive to one of the wet bulbs 60 and 62 whereas in the opposite circulating direction the other power vent is used as an exhaust vent and is response to the other one of wet bulbs 60 and 62. In alternative forms of or modes of operation for the system, the exhausting vent could be responsive to both wet bulbs 60 and 62, or both power vents could be operated as exhaust vents simultaneously. In the illustrated embodiment, however, if one of the power vents is operated as an exhaust vent, the other power vent is typically operated as an intake vent responsive to the differential pressure measurement provided by transmitter 66.

Figure 4:
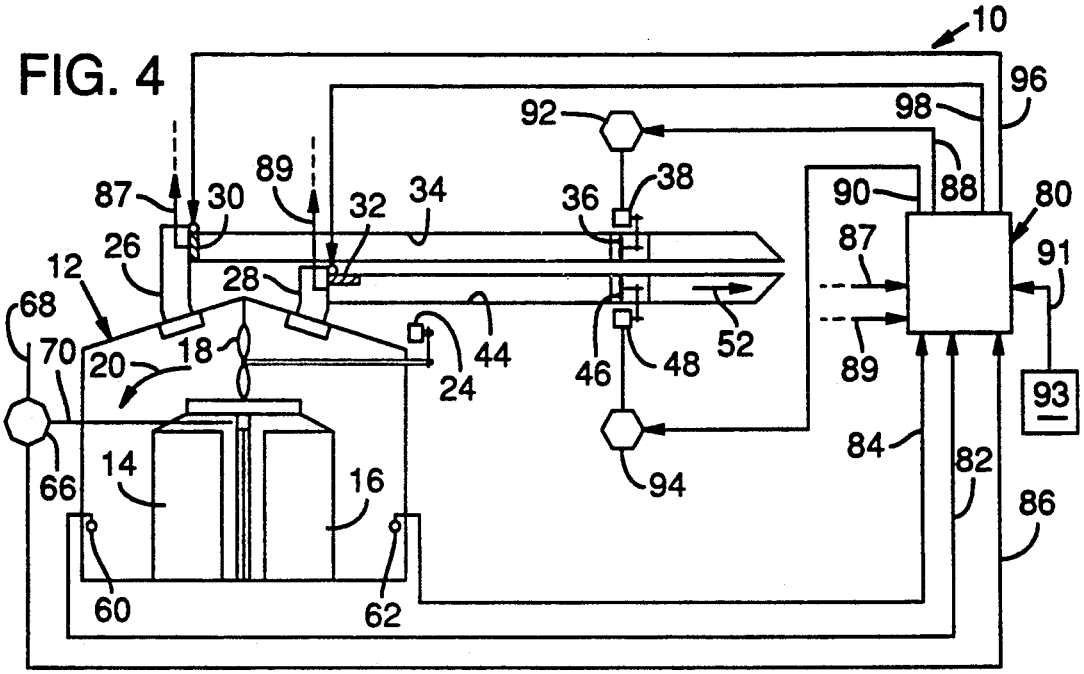
FIGS. 4–6 illustrate a forward venting mode of the balanced draft venting system of FIG. 1.

In the forward circulating direction 20, consider an initial condition where wet bulb 62 is above its set point, i.e., a system level parameter corresponding to a desired operating humidity for kiln 12. With reference to FIG. 4, control 80 uses the output 90 as applied to inverter drive 94 to control the direction and speed of the fan 46. The control 80 also applies power to maintain open the shut-off damper 32. Given confirmation by way of the signal 89 that damper 32 is open, the inverter drive 94 maintains the necessary voltage, i.e., a variable frequency AC voltage, to operate the fan 46 at a controlled speed and direction to take air out of the kiln as indicated by air outflow 52. The speed of fan 46 at this time is controlled dynamically in feedback fashion to maintain a given humidity within kiln 12, i.e., to maintain the output of the wet bulb 62 substantially at its humidity set point.

The differential pressure transmitter 66 monitors the kiln 12 internal pressure and outside pressure to provide a representation of differential pressure as the input 86 to control 80. Control 80 compares the input 86 to a given differential pressure set point. The differential pressure set point used by control 80 is a system level parameter corresponding to a desired operating differential pressure for the kiln 12. It may be desirable to provide a negative or a positive pressure differential within kiln 12 depending on, for example, the preference of the kiln operator or depending on the condition or type of kiln. Such a differential pressure set point is, therefore, variable in accordance with the present invention, but typically would be static per operational run.

Figure 5:
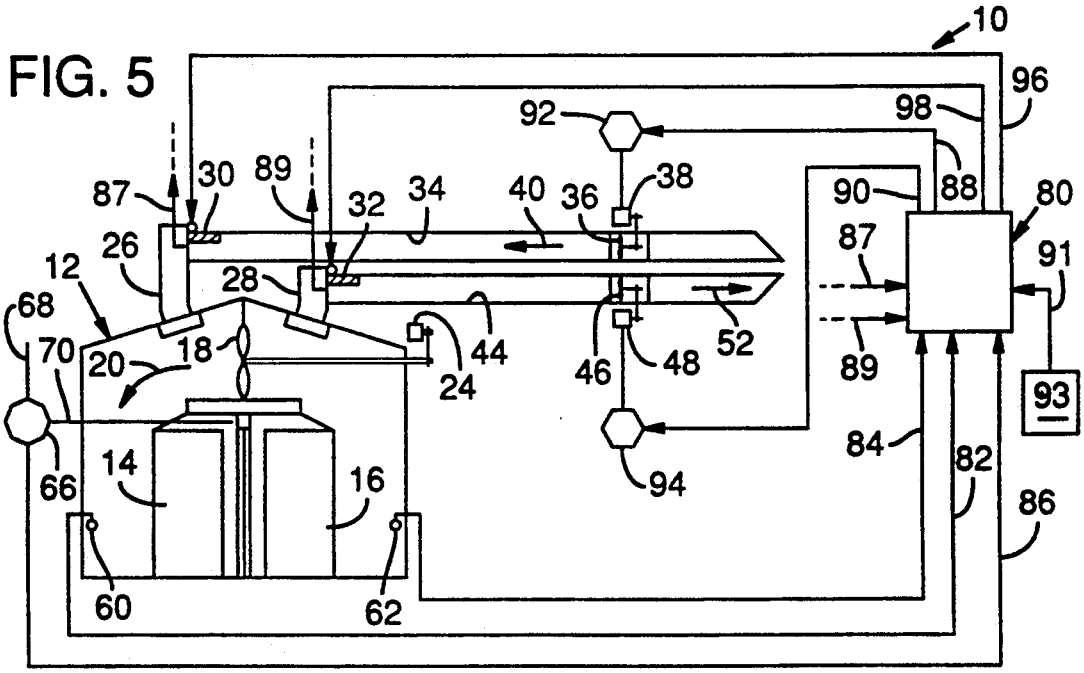

The air being removed from kiln 12 by way of fan 46 causes a change in differential pressure. This change in differential pressure is reflected in the signal 86 provided to control 80 by way of transmitter 66. As the pressure changes relative to the differential pressure set point, the control 80 outputs a suitable signal 88 to the inverter drive 92. If shut-off damper 30 is currently closed, the control 80 first sends power by way of output 96 to open the shut-off damper 30. In FIG. 5, the inverter drive 92 is instructed by way of signal 88 to provide voltage, i.e., variable frequency AC voltage, required to operate the fan 36 at a controlled speed and direction to push air into the kiln as indicated by air inflow 40. The speed at which the fan 36 operates is controlled dynamically in feedback fashion as a function of the differential pressure input 86 provided by transmitter 66. Thus, in controlling the speed of fan 36 to push air into the kiln 12, kiln differential pressure is maintained substantially at the selected differential pressure set point.

Figure 6:
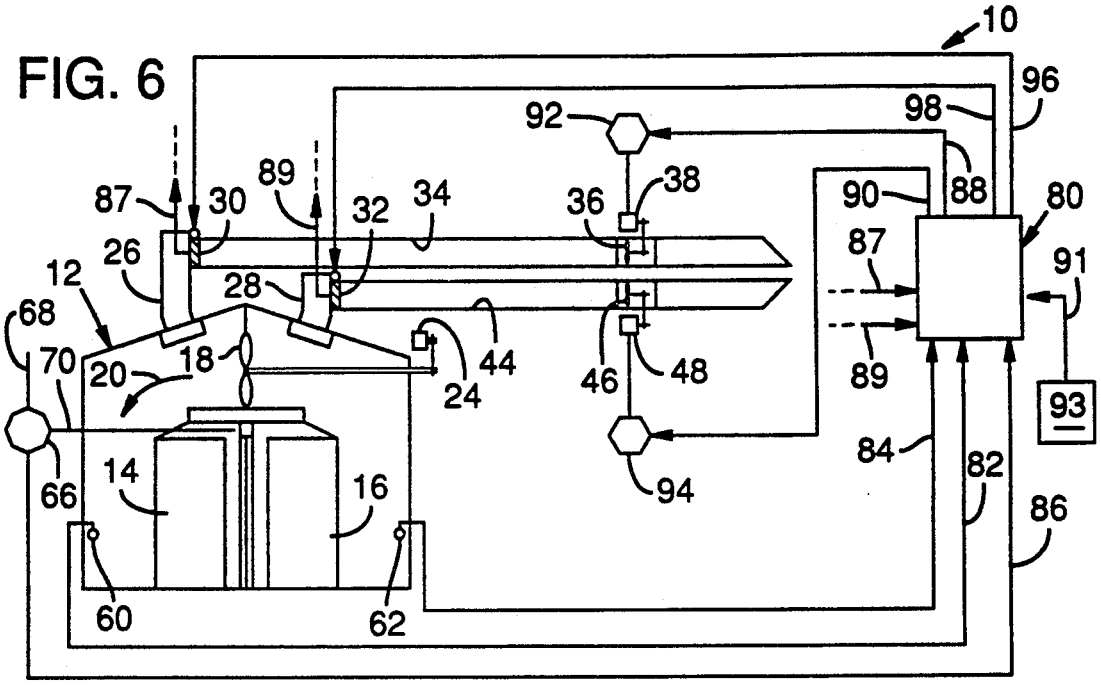

In FIG. 6, if the wet bulb 62 drops sufficiently below its set point, both shut-off dampers 30 and 32 are closed and both vent fans 36 and 46 can be shut. The balance draft system of the present invention opposes the forces of the internal circulating fan. This is a significant factor in the precise controllability of kiln conditions provided by the system of the present invention. When the rate of drying slows, the rate of venting slows as exhaust and intake fans slow down. At some point, the static pressure of fans 36 and 46 drops to the level of the internal circulating fans 18. At this point, the dampers 30 and 32 automatically close. For example, if the internal circulating fans 18 have $+/-1.0$ inches WC static pressure and the vent or intake fans 36 and 46 have $+/-3.0$ inches WC static pressure capability, then when the vent or intake fans slow down to 1.0 inches WC static pressure, the dampers close and the fans shut off until the conditions change. Under such conditions no air is exhausted from kiln 12 because the exhaust fan 36 or 46 and internal fans 18 are in exact balance. Generally, however, the control process remains in effect whereby fresh air comes into kiln 12 by way of one power vent assembly while moisture laden air exits kiln 12 by way of the other power vent assembly. The control process, therefore, is primarily focused on controlled variation in the operating speed for the fans 36 and 46 in such manner to maintain the desired kiln humidity and differential pressure settings.

As the circulating fan 18 continues operation in its forward direction 20, the humidity within kiln 12 builds to the point that the wet bulb 62 again rises above its set point and the abovedescribed control process applies. In this manner, the balance draft system maintains a given humidity level and differential pressure within kiln 12. As a result of this control arrangement, equal volumetric amounts of exhaust air and intake air are exchanged.

Figure 7:
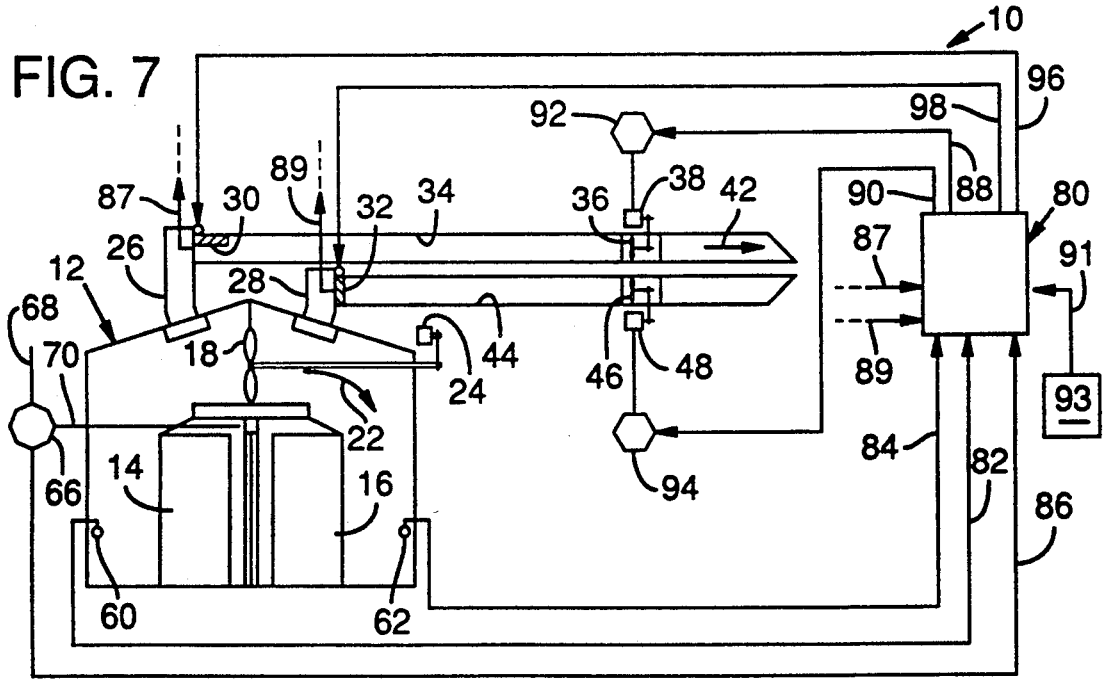
FIGS. 7–9 illustrate a reverse venting mode of the balanced draft system of FIG. 1.

In the reverse circulating direction 22, consider an initial condition where the wet bulb 60 is above the humidity set point. In FIG. 7, the control 80 generates output signal 88 to the inverter drive 92 and applies power at the output 96 to maintain open the shut-off damper 30. As illustrated in FIG. 7, the shutoff damper 32 is closed at this time, however, during normal control process operations both shut-off dampers 30 and 32 are typically maintained open while exhaust air and intake air are exchanged as a function of kiln humidity and differential pressure. The inverter drive 92 sends the necessary voltage to operate vent fan 36 at a controlled speed and direction to take air out of the kiln 12 as indicated by air outflow 42. The speed of fan 36 is controlled in feedback fashion with reference to the humidity within kiln 12, i.e., with reference to the humidity set point. The differential pressure transmitter 66 monitors the kiln 12 internal pressure and outside pressure and provides the input 86 to control 80.

Figure 8:
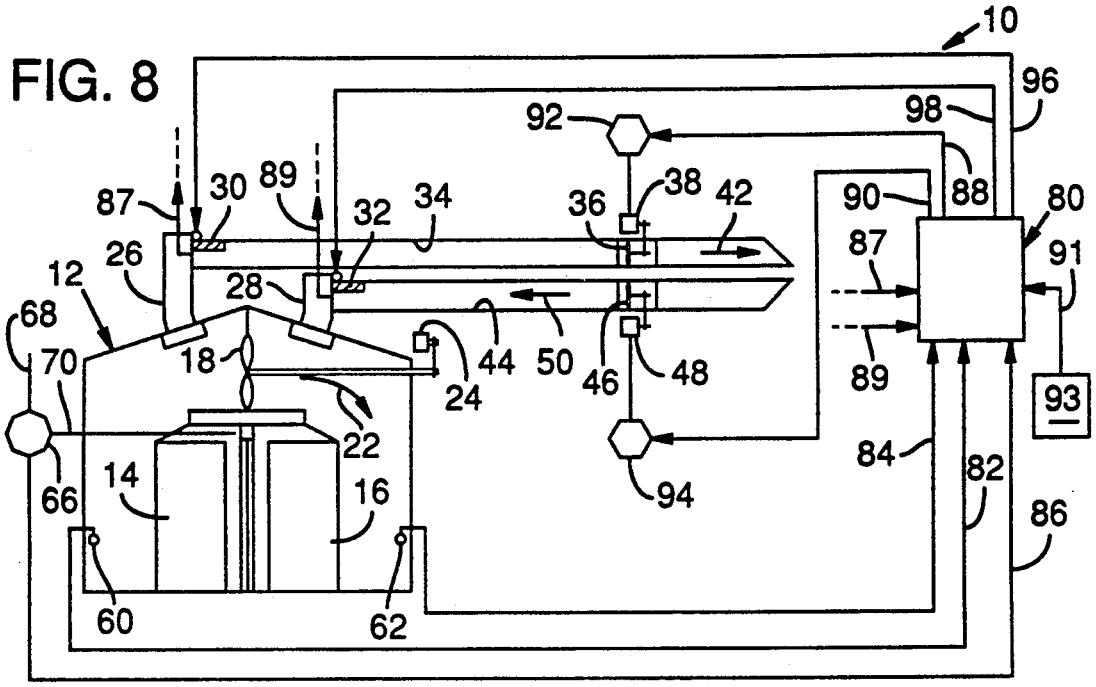

The air being removed from kiln 12 by vent fan 36 causes a change in differential pressure, a dramatic change in pressure if shut-off damper 32 is at this time closed. This change in differential pressure is reflected in the signal 86 from transmitter 66 as applied to the control 80. In FIG. 8, when the control 80 detects that the reported differential pressure changes relative to the selected differential pressure set point, control 80 opens, if necessary, the shut-off damper 32 and instructs the inverter drive 94 to send the necessary voltage required to operate vent fan 46 at a controlled speed and direction to push air into the kiln 12 as indicated by air inflow 50. Typically, however, the shut-off dampers 30 and 32 are both maintained open during the control process and the speed of fans 36 and 46 is maintained in feedback fashion. The speed of vent fan 46 is, at this time, dictated in feedback fashion by the differential pressure as reported by the transmitter 66 to the control 80.

Figure 9:
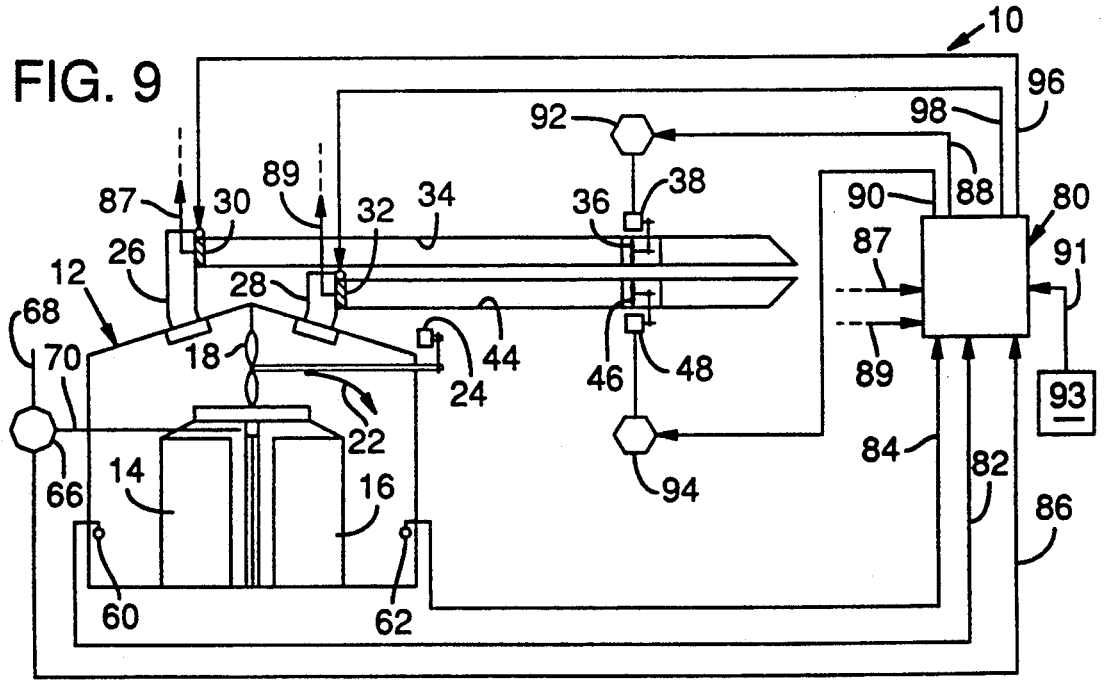

In FIG. 9, if the wet bulb 60 returns to substantially below its set point, both shut-off dampers 30 and 32 could be closed and vent fans 36 and 46 down. Eventually the humidity of air within the kiln 12 causes the wet bulb 60 to again rise above its set point and the above-described control process is reinstated.

Stated in more general terms, the venting logic of the present invention takes into account the direction of air circulation within the kiln 12 and utilizes the power venting capability of the balanced draft system in order to controllably exchange exhaust air and intake air as a function of the detected humidity within kiln 12 relative to a humidity set point and as a function of the detected differential pressure relative to a differential pressure set point. The intake of air is a function of the differential pressure reported to control 80 as compared to the differential pressure set point, and the exhaust of air is a function of the humidity within kiln 12 as reported by one of the wet bulbs 60 and 62.

Thus, depending on the direction of air circulation within kiln 12, the "wet side" of the kiln 12 is sampled for humidity in determining whether or not air is to be forced into the kiln 12 by means of one of the power vent assemblies. In the forward circulating direction 20 the wet bulb 62 is on the "wet side" of the stacks 14 and 16 and determines operation of the damper 32 and vent fan 46. In the reverse circulating direction 22, the wet bulb 60 is on the "wet side" of the stacks 14 and 16 and controls the exhaust of air by means of the damper 30 and vent fan 36. The air taken from the kiln 12 is always from the "wet side" of the stacks 14 and 16 whereby relatively cooler internal air, as cooled by the stacks 14 and 16, is exhausted from the kiln 12 and represents an energy savings feature provided by the present invention. Thus, in the forward circulating direction 20 kiln air cools as it passes through the stacks 14 and 16 and is taken from kiln 12 by means of the vent 28. In the reverse circulating direction 22, kiln air passes through stacks 14 and 16 and is taken from the vent 26.

As may be appreciated, the circulating fans 18 are an extremely powerful motive force within the kiln 12. The circulating fans required in such lumber drying kilns can produce significant differential pressure on each side of the circulating fan and develop high circulating velocity. Thus, the circulating fans 18 affect significantly the condition of air circulation within the kiln 12. The venting control logic of the present invention, however, is substantially unaffected by the dramatic changes in air circulation provided by the circulating fan 18. The venting logic is provided as a function of circulating fan 18 mode of operation, i.e., its direction, but the control arrangement of the present invention is otherwise substantially unaffected by the dramatic air circulation changes within kiln 12. As a result, an optimized exchange of exhaust air and intake air is provided in the process of removing moisture content from the lumber within kiln 12.

An implosion control mode is also provided and initiated at start-ups, i.e., for a cold kiln 12, or during reversal of fans 18. This implosion control mode opens both shut-off dampers 30 and 32 and powers both vent fans 36 and 46 to push air into the kiln 12 at a pre-set speed for a selected time, e.g., between 0 and 60 seconds. Before the vent in begins, however, it is necessary that the limit switches (not shown) of shut-off dampers 30 and 32 indicate to the control 80 that the vents 30 and 32 are open.

Figure 10:
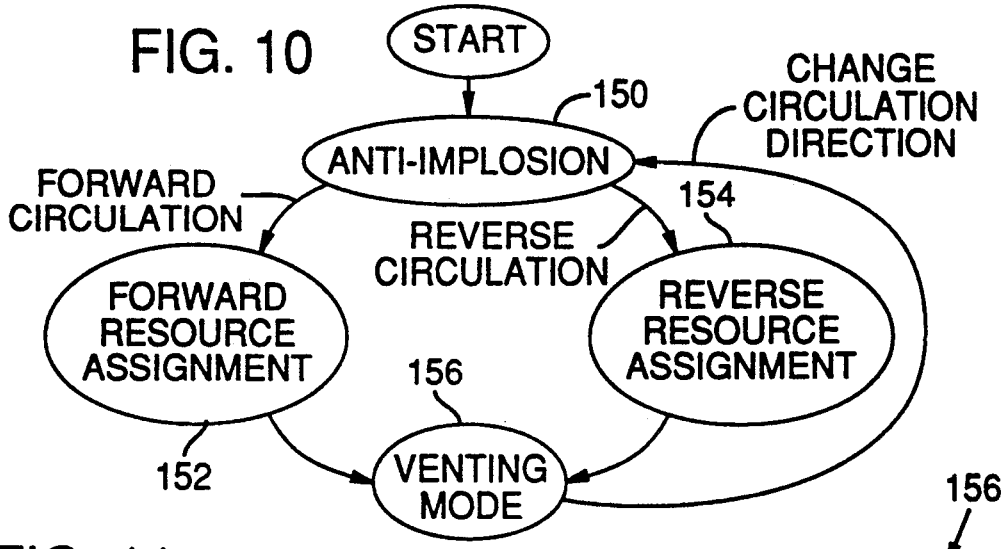
FIG. 10 is a state diagram illustrating control of the balanced draft venting system.

FIG. 10 is a state diagram illustrating generally the operating mode of the balanced draft venting system according to the present invention. In FIG. 10, at start-up the system 10 enters the anti-implosion state 150 where, as described above, the vents 36 and 46 are activated to push air into the kiln 12 at a preset speed in order to avoid potential damage to the kiln 12 resulting from sudden cooling of the air within kiln 12 upon initial circulation of air through the stacks 14 and 16. Once the kiln internal air is sufficiently heated and well circulated, the anti-implosion state 150 is terminated and system 10 is prepared for venting according to the direction of circulation provided by fans 18.

If the fans 18 are to be operated in the forward circulating direction 20, the system 10 passes from anti-implosion state 150 to forward resource assignment state 152. If, on the other hand, fans 18 are to be operated in the reverse circulation direction 22, system 10 passes from anti-implosion state 150 to reverse resource assignment state 154. In the states 152 and 154, system 10 determines which of the power vents will be used as intake vents, which will be used as exhaust vents, and which of the wet bulbs 60 and 62 will be utilized in determining operation of the exhaust vent. More particularly, in the forward resource assignment state 152 system 10 identifies the power vent assembly comprising fan 46, damper 32 and vent 28 as the exhaust vent and identifies the power vent assembly comprising fan 36, damper 30, and vent 26 as the air intake vent. Also in state 152, system 10 identifies the wet bulb 62 as the sensor to be monitored in determining "wet side" humidity. In the reverse resource assignment state 154, system 10 identifies the power vent comprising fan 36, damper 30 and vent 26 as the exhaust vent and identifies the power vent assembly comprising fan 46, damper 32 and vent 28 as the air intake vent. Also in state 154, system 10 identifies wet bulb 60 as the "wet side" humidity indicator.

Figure 11:
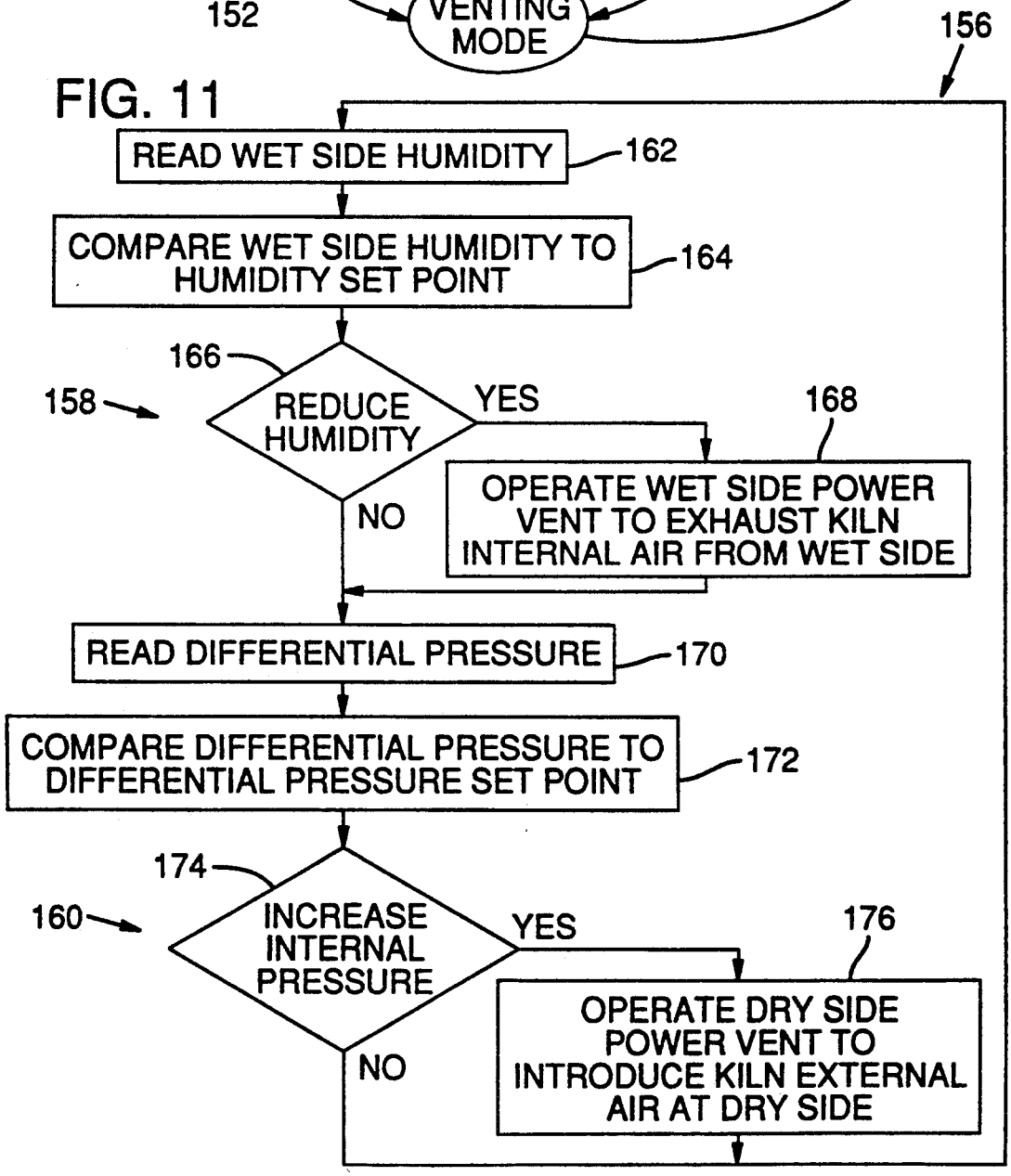
FIG. 11 is a flow diagram illustrating a venting mode of the balanced draft venting system.

Following resource assignment in the states 152 and 154 as a function of circulating fans 18 mode of operation, system 10 enters a venting mode state 156. In venting mode state 156, system 10 exhausts cool moisture laden air from the wet side of kiln 12 as a function of the wet side humidity sensor. Also in venting mode state 156, system 10 introduces external air into the kiln 12 by means of the selected air intake power vent assembly as a function of the differential pressure measurement provided by transmitter 66. As previously described, the venting mode 156 generally maintains both shut-off dampers 30 and 32 in an open condition and suitably operates the fans 36 and 46 at such speed so as to maintain the required kiln humidity and differential pressure in feedback fashion. FIG. 11 is a flow chart illustrating generally the control provided by the venting mode state 156.

In FIG. 11, two control loops 158 and 160 are illustrated in series. The control provided in each of loops 158 and 160 is substantially independent and could be implemented in parallel as by separate control elements, but are shown herein in series for the purpose of illustration. The upper control loop 158 maintains kiln internal humidity in feedback fashion relative to a selected humidity set point. The lower control loop 160 maintains kiln differential pressure relative to a selected differential pressure set point. In each case, the particular vents actuated and sensors monitored are a function of circulating fans 18 mode of operation, i.e., direction of circulation provided, as provided in the abovedescribed resource assignment states 152 and 154.

In block 162 of control loop 158, system 10 first reads the wet side humidity measurement and, in block 164, compares this value to the humidity set point. In decision block 166 the system 10 determines whether or not kiln internal humidity must be reduced. If humidity within kiln 12 is above the humidity set point, then processing passes from decision block 166 to block 168 where system 10 operates the wet side power vent to exhaust kiln internal air from the wet side of kiln 12. Typically, the processing invoked in block 168 would relate to an adjustment in the operating speed for the wet side power vent. The speed at which the wet side power vent is operated may be provided, for example, as a function of the difference between the detected kiln humidity and the selected humidity set point. Processing then continues to block 170 of lower control loop 160. If no reduction in humidity is required in decision block 166, processing branches directly from block 166 to block 170.

In block 170, system 10 reads the differential pressure measurement as provided by the transmitter 66. In block 172, system 10 compares the detected differential pressure to a selected differential pressure set point. In decision block 174, system 10 determines whether the kiln internal pressure need be increased. If the kiln internal pressure is satisfactory, processing returns to block 162. If the kiln internal pressure needs to be increased, typically as a result of the removal of air provided by the upper control loop 158, processing branches from block 174 to block 176 where system 10 operates, i.e., modifies the operating speed of, the dry side power vent to adjust the volume of kiln external air introduced at the dry side of kiln 12. In such operation of the dry side power vent, the speed of the associated fan motor is provided, for example, as a function of the difference between the detected differential pressure and the selected differential pressure set point. The kiln differential pressure is thereby maintained in feedback fashion substantially at the selected differential pressure set point. Processing then passes from block 176 and returns to block 162.

The system 10 thereby maintains both kiln humidity and kiln differential pressure at selected set points. The venting mode state 156 as illustrated in FIG. 11 continues until such time that the input 91 to control 80 indicates a change in circulating direction. Returning to FIG. 10, the system 10 then passes from venting mode state 156 back to the anti-implosion state 150 during the intervening condition of fan reversal within kiln 12. Upon exiting the anti-implosion state 150, system 10 then passes through one of the states 152 and 154, depending on circulation direction, and identifies the necessary resources, i.e., wet and dry side power vents and associated sensors, for executing the venting mode state 156 as illustrated in FIG. 11.

While the present invention has been described thus far with one pair of power vents and associated control functions for removing cool air from the wet side of the kiln as a function of kiln humidity and introducing air into the kiln at the dry side of the kiln as a function of a differential pressure measurement, it will be appreciated that multiple such power vent pairs and associated kiln condition sensors may be employed independently or in parallel.

Figure 2:
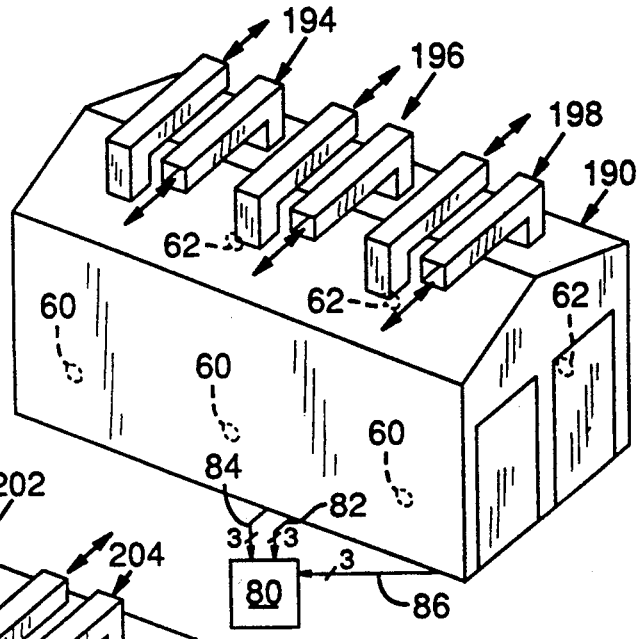
FIGS. 2 and 3 are perspective views of kiln systems of the present invention.
Figure 3:
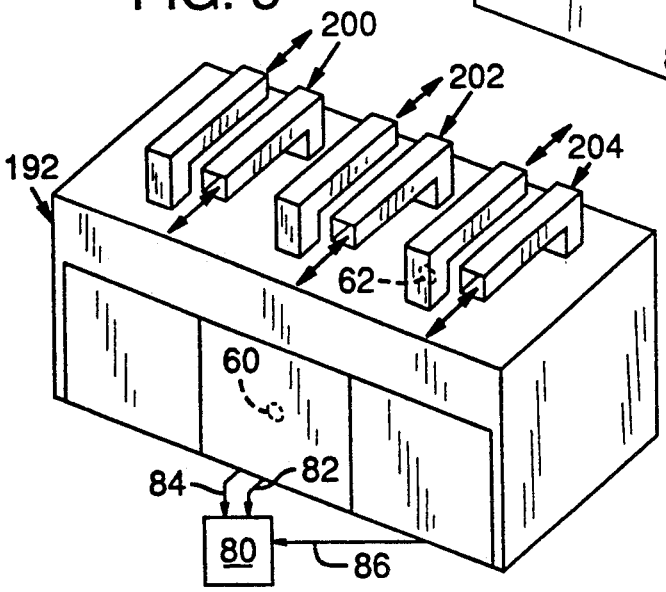

FIGS. 2 and 3, illustrate end-loading and side loading kilns 190 and 192, respectively, each with several power vent pairs. In FIG. 2, the kiln 190 includes power vent pairs 194, 196 and 198. Each power vent pair includes an arrangement similar to that described thus far with shut-off dampers and variable speed bi-directional fan motors for each vent whereby each power vent pair may be operated as described above in response to humidity and differential pressure conditions of the kiln 190. A similar arrangement is shown in FIG. 3 where the kiln 192 includes power vent pairs 200, 202, and 204. In each of the systems illustrated in FIGS. 2 and 3 a variety of sensor and control arrangements may be provided.

For example, in FIG. 2 each of the power vent pairs 194, 196 and 198 includes an associated pair of left and right wet bulbs 60 and 62. Similarly, each of the power vents 194, 196 and 198 includes an associated differential pressure input 86 for application to the control 80. In operation of the system shown in FIG. 2 each power vent pair operates independently in the manner described above. Thus, for the end-loading kiln 196, as the lumber product moves through the kiln 190, variation in kiln humidity may occur over the length of the kiln 190. By operating independently the power vent pairs 194, 196 and 198 a more precise use of the intake and exhaust functions for kiln 190 is provided by each of the power vent pairs.

In the side loading kiln 192 of FIG. 3, one pair of wet bulbs, i.e., 60 and 62, are employed for humidity detection throughout kiln 192 and a single internal pressure measurement is taken whereby the power vent pairs 200, 202 and 204 may be operated in parallel. Thus, where lumber product moisture content is more uniform across the length of the kiln 192, the detection of humidity and pressure differential is simplified by a reduced number of humidity and pressure sensors and by control logic applied in parallel to each of the power vents 200, 202 and 204.

The balanced draft system of the present invention provides a high degree of control over a precise level of humidity within kiln 12. Control over humidity within kiln 12 may be accomplished within very narrow specifications, much more narrow than that provided in previous kiln control systems. For example, prior venting systems making use of internal circulating fans to vent and bring in fresh air can only control humidity within a range of approximately five degrees Fahrenheit. The balance draft system of the present invention, however, has the ability to hold the wet bulb temperature, i.e., humidity, within +/−0.1 degrees Fahrenheit of the desired set point. The key to this precision in humidity control is the differential pressure measurements, which automatically compensate for the effects of wind velocity, outside or inside air temperatures, wind direction, atmospheric pressure, inside pressure due to air expansion, or rate of moisture removal. Thus, the humidity maintained within kiln 12 may be held very close to a selected value.

The balance draft system of the present invention makes possible more effective use of the energy applied to the system, i.e., energy applied to heating of air within the kiln 12. A key purpose of the balance draft system of the present invention is to maximize energy applied to heating of the air media within the kiln 12. More particularly, this is made possible by virtue of the described power vent pairs which may be positioned relative to the heating elements of the kiln 12 and with respect to air circulation within kiln 12 in such manner that cooler moisture laden air is taken from kiln 12 prior to its being heated. Thus, under the balance draft system of the present invention, all fresh, i.e., dryer, air is heated and then forced through the lumber to carry away moisture. All wet, i.e., cooler, air is exhausted prior to being reheated or mixed with fresh air. An exact balance between the rate of venting and the rate of introducing fresh replacement air is maintained. If these are not balanced, significant loss of energy can occur. This balance is maintained over a large variation of internal conditions including air velocity, the method of stacking lumber, conditions of baffles, rate of drying, dryness of lumber, thickness of lumber, species of lumber, where the lumber was grown, old growth versus smaller new growth logs, operation of heating system including the potential for malfunction, and the type of heat system used. Despite the wide variation in conditions existing within the kiln, the balance draft system of the present invention maintains the necessary balance of intake and venting functions to achieve maximum use of heating energy applied to the kiln 12.

It will be appreciated that the present invention is not restricted to the particular embodiment that has been described and illustrated, and that variations may be made therein without departing from the scope of the invention as found in the appended claims and equivalence thereof. For example, while a particular vent configuration has been shown and described, it will be understood that the present invention works with one vent on each side or with multiple vents on each side of the kiln. Also, the location of the shut-off dampers 30 and 32 can be anywhere along the ducts 34 or 44, respectively, including either side of the fans 36 and 46, respectively. While only two wet bulbs 60 and 62 have been shown, it may be appreciated that other methods may be employed to determine the ability of the air exiting the lumber to absorb more moisture. Finally, while particular analog or pulse digital signals have been specified, it will be understood that a variety of control systems may be employed given the description of the particular embodiment of the present invention to accomplish the system control features described herein.

What is claimed is:

1. In a lumber drying kiln receiving a charge to be dried, a vent system comprising:

a circulating fan defining as a function of the resulting circulation of air through the charge a kiln wet side where air flow is in a direction from the charge to the circulating fan and a kiln dry side where air flow is in a direction from the circulating fan to the charge;

a differential pressure detection element indicating differential pressure between the kiln internal pressure and external ambient air pressure conditions;

a humidity detection element at said wet side indicating an ability of kiln internal air to hold more moisture;

a control receiving said differential pressure indication and said humidity indication;

first and second power vents each operable at controlled rate and direction; and control logic dictating operation of said power vents for removing of kiln internal air by way of one of said power vents in response to said humidity indication and introducing kiln external air into said kiln by way of the other one of said power vents in response to said differential pressure indication.

2. A vent system according to claim 1 wherein said control logic operates said first and second power vents in such manner to maintain in feedback fashion the humidity indication substantially at a given humidity set point and the differential pressure indication substantially at a given differential pressure set point.

3. A vent arrangement for a kiln adapted for removing moisture content from a kiln charge therein, the vent arrangement comprising:

a circulating fan defining as a function of the resulting circulation of air through the charge a kiln wet side where air flow is in a direction from the charge to the circulating fan and a kiln dry side where air flow is in a direction from the circulating fan to the charge;

a first vent responsive to a humidity sensor at said wet side for removing kiln air from said wet side as a function of humidity within the kiln; and a second vent responsive to a pressure sensor for introducing air into the kiln at said dry side as a function of a pressure differential between kiln internal air and kiln external air.

4. A vent arrangement according to claim 3 wherein said vents are power vents.

5. A vent arrangement according to claim 3 wherein said first vent includes a fan driven by a fan motor in feedback fashion to maintain humidity within said kiln relative to a given humidity set point.

6. A vent arrangement for a kiln adapted for removing moisture content from a kiln charge therein by air circulation therethrough, the vent arrangement comprising:

a first vent responsive exclusively to a humidity sensor for removing kiln air as a function of humidity within the kiln, said humidity being measured at a point downstream relative to air circulation through said charge; and a second vent responsive exclusively to a pressure sensor for introducing air into the kiln as a function of a pressure differential between kiln internal air and kiln external air, said second vent taking air from a dry side of the kiln charge, the dry side being upstream relative to air circulation through said charge.

7. A vent arrangement according to claim 6 wherein said second vent includes a fan driven by a fan motor in feedback fashion to maintain differential pressure between kiln internal pressure and kiln external pressure relative to a given differential pressure set point.

8. A method of operating a kiln adapted for removing moisture content from a kiln charge therein, the kiln including a circulating fan defining as a function of the resulting circulation of air through the charge a kiln wet side where air flow is in a direction from the charge to the circulating fan and a kiln dry side where air flow is in a direction from the circulating fan to the charge, the method comprising:

detecting a kiln internal humidity at said wet side;

detecting a differential pressure between kiln internal pressure and kiln external pressure;

exhausting kiln internal air from said wet side as a function of detected kiln internal humidity; and introducing kiln external air into the kiln at said dry side as a function of detected differential pressure.

9. A method according to claim 8 wherein said method further comprises:

establishing a humidity set point representing a desired kiln internal humidity;

establishing a differential pressure set point representing a desired pressure differential between kiln internal air pressure and kiln external air pressure;

executing said exhausting step in feedback fashion to maintain said detected kiln internal humidity substantially at said humidity set point; and executing said introducing step in feedback fashion to maintain said detected differential pressure.

10. A vent arrangement for a kiln, the vent arrangement comprising:

a bi-directional circulating fan providing forward and reverse directions of circulation within the kiln, the direction of circulation at a given time defining a dry side and a wet side of the kiln, the wet side being downstream from a charge, the dry side being upstream from a charge;

first and second bi-directional power vents so located within the kiln that depending on circulating fan direction one power vent is the wet side of the kiln charge and the other power vent is on the dry side of the kiln charge;

first and second humidity detection elements so located within the kiln that depending on circulating fan direction one is on the wet side of the kiln charge and the other is on the dry side of the kiln charge, the humidity detection element on the wet side of the charge providing a measure of humidity;

a differential pressure detection element providing a measure of differential pressure between kiln internal and kiln external air pressure; and a control receiving said measure of humidity and said measure of differential pressure, said control being adapted to operate said first and second power vents in such manner that the power vent on the wet side of the kiln is actuated to exhaust air as a function of the measure of humidity relative to a given humidity set point and the power vent on the dry side of the kiln is actuated to draw air into the kiln as a function of the measure of differential pressure relative to a given differential pressure set point.

11. A vent arrangement according to claim 10 wherein said control operates said power vents in feedback fashion to maintain said measure of humidity substantially at said humidity set point and to maintain said measure of differential pressure substantially at said differential set point.

12. In a lumber drying kiln providing air circulation through a charge, a vent system comprising:

a differential pressure detection element indicating differential pressure between the kiln internal pressure and external ambient air pressure conditions;

a humidity detection element indicating an ability of kiln internal air to hold more moisture;

a control receiving said differential pressure indication and said humidity indication;

first and second power vents each operable at controlled rate and direction; and control logic for removing of kiln internal air by way of one of said power vents and introducing kiln external air into said kiln by way of the other one of said power vents as a function of said differential pressure indication and said humidity indication, respectively, said humidity indication being taken from a wet side of said charge within said kiln, said wet side being defined as downstream of air circulated through said charge, the power vent removing air from the kiln removing kiln internal air from said wet side.

13. A method of operating a kiln adapted for removing moisture content from a kiln charge therein, the method comprising:

circulating kiln internal air through said charge;

detecting a kiln internal humidity at charge wet side downstream from air circulated therethrough;

detecting a differential pressure between kiln internal pressure and kiln external pressure;

exhausting kiln internal air at said wet side as a function of detected kiln internal humidity measure at said wet side;

introducing kiln external air into the kiln as a function of detected differential pressure, said introducing step being executed on a dry side of said charge upstream from air circulated therethrough;

establishing a humidity set point representing a desired kiln internal humidity;

establishing a differential pressure set point representing a desired pressure differential between kiln internal air pressure and kiln internal air pressure;

executing said exhausting step in feedback fashion as a function of said detected kiln internal humidity to maintain said detected kiln internal humidity substantially at said humidity set point; and executing said introducing step in feedback fashion as a function of said detected differential pressure to maintain said detected differential pressure substantially at said differential pressure set point.

* * * * *